United States Patent [19]

Linecker

[11] Patent Number: 4,459,766

[45] Date of Patent: Jul. 17, 1984

[54] CROSS-COUNTRY SKI SHOE

[76] Inventor: Josef Linecker, Rosengasse 5, Mattighofen, A-5230, Austria

[21] Appl. No.: 405,389

[22] Filed: Aug. 5, 1982

Related U.S. Application Data

[62] Division of Ser. No. 892,770, Apr. 3, 1978, Pat. No. 4,392,313, which is a division of Ser. No. 122,698, Feb. 19, 1980, Pat. No. 4,235,452.

[30] Foreign Application Priority Data

Feb. 9, 1978 [AT] Austria ..... 924/78

[51] Int. Cl.[3] ..... A43B 5/04; A43B 13/00

[52] U.S. Cl. ..... 36/117; 36/30 R

[58] Field of Search ..... 36/117, 30 R, 30 A, 36/31, 44, 103, 124

[56] References Cited

U.S. PATENT DOCUMENTS

| | | | |
|---|---|---|---|
| 2,363,995 | 11/1944 | Rollman et al. | 36/30 R |
| 2,440,705 | 5/1948 | Supple | 36/30 R |
| 3,490,155 | 1/1970 | Herunter | 36/117 |
| 3,842,518 | 10/1974 | Famolare, Jr. | 36/117 |
| 4,067,126 | 1/1978 | Bergeron et al. | 36/117 |
| 4,335,531 | 6/1982 | Salomon | 36/117 |

FOREIGN PATENT DOCUMENTS

| | | | |
|---|---|---|---|
| 223524 | 10/1924 | United Kingdom | 36/44 |

*Primary Examiner*—Werner H. Schroeder
*Assistant Examiner*—Steven N. Meyers
*Attorney, Agent, or Firm*—Kurt Kelman

[57] ABSTRACT

A ski shoe for use with a cross-country ski, comprising a sole extending in a longitudinal direction and having a region accommodating the ball of the foot of a wearer of the ski shoe, the sole including transverse strips of a rigid but thin sheet material arranged solely in said region and being spaced from each other in said direction.

6 Claims, 3 Drawing Figures

CROSS-COUNTRY SKI SHOE

This is a division of Ser. No. 892,770, filed Apr. 3, 1978, now U.S. Pat. No. 4,392,313, dated July 12, 1983, which is a division of Ser. No. 122,698, filed Feb. 19, 1980, now U.S. Pat. No. 4,235,452, dated Nov. 25, 1980.

The present invention relates to a ski shoe for use with a cross-country ski.

Conventionally, the soles of ski shoes for use with a cross-country ski are of synthetic resin, and it is desirable to make these synthetic resin soles so that they do not warp. However, if a sole is resistant to flexure so that it does not tend to warp and if it extends in a flat plane, it cannot be used for cross-country skiing because such a stiff sole will rapidly tire the foot of the skier.

It is a primary object of this invention to improve a shoe for use in cross-country skiing by increasing the transverse stiffness of the shoe sole.

The above and other objects are accomplished according to this invention with a cross-country ski shoe comprising a sole means including transverse strips of a rigid but thin sheet material arranged in the region of the ball of the foot of the wearer of the ski shoe and spaced from each other in the longitudinal direction of the shoe sole means.

Figure 1:
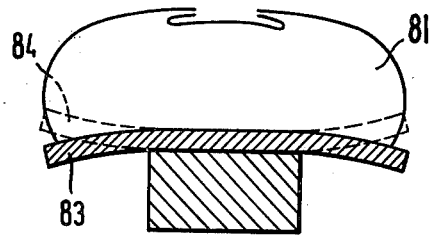
Figure 2:
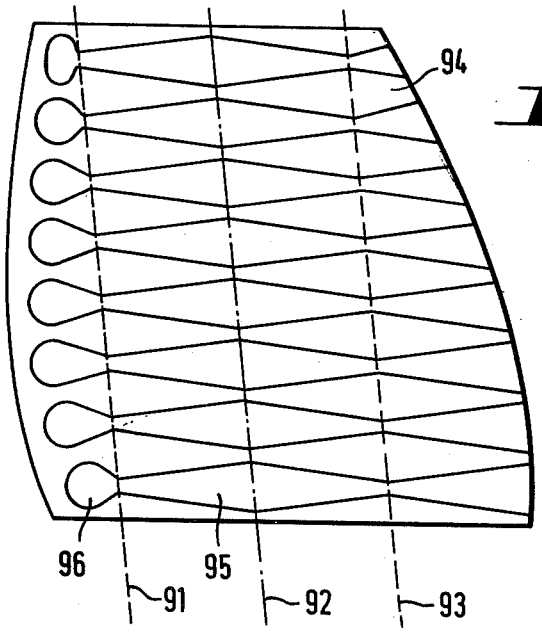
Figure 3:
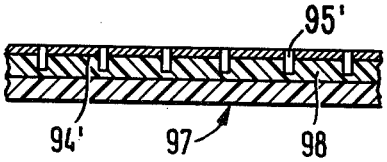

The above and other objects, advantages and features of the invention will become more apparent from the following detailed description of a new preferred embodiment thereof, taken in conjunction with the accompanying schematic drawing wherein FIG. 1 is a transverse section showing an embodiment of a ski shoe with the sole mounted on a ski; and FIGS. 2 and 3 are respectively plan and sectional views illustrating respective embodiments of transverse stiffening inserts for the shoe sole.

Boots for use in cross-country skiing must be light and flexible, particularly below the balls of the feet. Therefore, the soles of such boots are necessarily quite jesilient in a transverse direction, which makes the lateral guidance of the ski very difficult.

Cross-country skis are narrow, in contrast to downhill skis whose width is about 45 mm. Because of the narrowness of cross-country skis, the feet of the skier, particularly in the regions of the balls of the feet, overhang the ski laterally and vertical pushing forces up to 150 kg have been measured. Under such forces, as indicated in FIG. 1, the laterally overhanging portions of sole 83 tend to curve down. The skier, therefore, feels the pressure of the narrow ski 82 against the sole of his foot, particularly in the center region. This causes undue fatigue and pain during a long cross-country run. While it is possible to reduce or avoid this difficulty by increasing the gauge of the sole and, thus, its rigidity, this produces a corresponding weight increase, which is undesirable.

As shown in FIG. 1, this difficulty is overcome if the sole extends in an upwardly curvilinear plane 84, i.e. it is concave in a transverse direction. Thus, a downward force will bring the sole into a flat condition, rather than curving downwardly over the lateral edges of the ski. This will relieve the pressure of the narrow ski against the sole and also will stretch the uppers 81 when the overhanging lateral portions of the sole are straightened so that the uppers will be free of undesirable folds produced during cross-country skiing.

It has been found in the production of ski boots with curvilinear soles that it is difficult to mount the uppers on the insole. The transverse stiffness of the sole means, particularly below the region of the ball of the foot, may be increased by making the sole of a transversely sculptured sheet material which provides a strong moment of resistance in a transverse direction for the overhanging lateral portions of the sole without imparting any significant resistance to a rolling motion in the longitudinal direction of the ski. Since it is difficult to find a suitable material having the desired rigidity characteristics, the invention provides in the embodiment shown in FIG. 2 an insole of a rigid but this sheet material, such as an aluminum sheet or a synthetic resin sheet, which is bonded to the outer sole in transverse strips. An aluminum sheet having a gauge of about 0.2 to 0.5 mm is sufficient for this purpose. In the bottom plan view of FIG. 2, the lateral edges of a ski are designated by numerals 91 and 93 while the central axis of the ski is designated 92. It will be noted that the width of the transverse strips extending beyond ski edges 91 and 93 are widest where the load of the foot exerts the highest flexing forces and is reduced gradually from the lateral ski edges towards the ski axis. Thus, material is saved where it is not needed to stiffen the sole and the weight of the sole is held as low as possible. Other strip shapes are possible, of course, but the illustrated configuration will produce maximum stiffness with minimum weight. To form strips 94 in the region of the ball of the foot of the wearer, transverse grooves constituted by slits 95 end in rounded loops 96 adjacent ski edge 91 and leave a narrow rim interconnecting all strips to increase the lateral stiffness of the sole. At this part of the sole, the strongest pressure forces are transmitted from the foot to the sole. At the opposite side adjacent ski edge 93, there is no connection between the insole strips, slits 95 extending to the ends of the strips and the edge of the sole.

As shown in the transverse section of FIG. 3, which shows the shoe sole in the region of a ski edge, outer sole 97 carries insole 98 and an upper layer consisting of transverse strips 94'. This produces a laminate consisting of outer sole, edge of uppers, insole and strips producing maximum stiffness with a minimum of material and weight. In most cases, an aluminum strip layer weighing about 2 to 3 grams will suffice, the weight of the strip layer configurated according to FIG. 2 being about 2 g while parallel strips will have a weight of about 3 g, with a sheet gauge of 0.2 mm. Transverse slits 95' between the strips 94' are very important because, when the insole is flexed, the absence of such slits would cause the insole to be compressed only to the width of the strips, which amounts to an increase in the rigidity in a longitudinal direction in comparison to a sole without transverse strips and which may be compressed uniformly along its entire length. The slits separate the strips from each other. As shown in FIG. 3, slits 95' have a width less than that of strips 94' and a depth larger than half the thickness of insole 98.

What I claim is:

1. A light ski shoe for use with a cross-country ski, comprising a flexible sole means extending in a longitudinal direction and having a region accommodating the ball of the foot of a wearer of the ski shoe, the sole means having lateral edges and a portion extending therebetween and adapted to be partly in registry with an underlying ski having lateral edges spaced inwardly from, and extending in the direction of, the lateral edges of the sole means, and the sole means portion including transverse strips of a rigid but thin sheet material arranged solely on one side of the sole means and solely in said region and being separated from each other in said direction by transverse grooves.

2. The ski shoe of claim 1, wherein the sheet material is aluminum, the aluminum sheet material having a gauge of about 0.2 to 0.5 mm.

3. The ski shoe of claim 1 or 2, wherein the sole means comprises an outer sole and an inner sole, the transverse strips being bonded to the inner sole.

4. The ski shoe of claim 1 or 2, further comprising a thin web connecting the spaced transverse strips.

5. The ski of claim 1 or 2, wherein the sole means comprises an outer sole and an inner sole, the inner sole defining the transverse grooves between the strips, and the strips being bonded to the inner sole between the grooves.

6. The ski shoe of claim 5, wherein the grooves are slits having a width less than that of the strips and a depth larger than half the thickness of the inner sole.

* * * * *